United States Patent [19]

Levin et al.

[11] Patent Number: 4,655,855

[45] Date of Patent: Apr. 7, 1987

[54] METHOD FOR REFINING MICROSTRUCTURES OF PREALLOYED TITANIUM POWDER COMPACTED ARTICLES

[75] Inventors: Lev Levin, Haifa, Israel; Russell G. Vogt; Daniel Eylon, both of Dayton, Ohio; Francis H. Froes, Xenia, Ohio

[73] Assignee: The United States of America as represented by the Secretary of the Air Force, Washington, D.C.

[21] Appl. No.: 758,926

[22] Filed: Jul. 25, 1985

[51] Int. Cl.[4] ..... C22F 1/02

[52] U.S. Cl. ..... 148/20.3; 148/126.1

[58] Field of Search ..... 148/20.3, 133, 126.1

[56] References Cited

PUBLICATIONS

F. H. Froes and J. R. Pickens, "Powder Metallurgy of Light Metal Alloys for Demanding Applications", Journal of Metals, vol. 36, No. 1, Jan. 1984, pp. 14–28.

*Primary Examiner*—R. Dean

*Attorney, Agent, or Firm*—Charles E. Bricker; Donald J. Singer

[57] ABSTRACT

The microstructure of titanium alloy powder compacts is refined and improved by a method which comprises beta solution heat treating the compact, hydrogenating and then dehydrogenating the compact.

7 Claims, 4 Drawing Figures

METHOD FOR REFINING MICROSTRUCTURES OF PREALLOYED TITANIUM POWDER COMPACTED ARTICLES

RIGHTS OF THE GOVERNMENT

The invention described herein may be manufactured and used by or for the Government of the United States for all governmental purposes without the payment of any royalty.

BACKGROUND OF THE INVENTION

This invention relates to the processing of titanium articles fabricated by powder metallurgy to improve the microstructure of such articles.

In general terms, powder metallurgy involves production, processing and consolidation of fine particles to produce a solid article. The small, homogeneous powder particles result in a uniform microstructure in the final product. If the final product is made net-shape by application of hot isostatic pressing (HIP), a lack of texture can result, thus giving equal properties in all directions.

Titanium powder metallurgy is generally divided into two "approaches", the "elemental approach" and the "pre-alloyed approach". With the "elemental approach", the small (−100 mesh) regular grains of titanium normally rejected during the conversion of ore to ingot (commonly called "sponge fines"), are used as starting stock. Alloy additions, normally in the form of a powdered master alloy, are made to these fines, so that the desired bulk chemistry is achieved. The blended mixture is then compacted cold, under pressures up to 420 MPa (60 ksi), to a density of 85–90%. This operation can be carried out either isostatically or with a relatively simple mechanical press. The "green" compact is then sintered to increase density to 95–99.8% theoretical density and to homogenize the chemistry. The cold isostatic pressing is often referred to as CIP. A further increase in density can be achieved by hot isostatic pressing the article, which also generally improves the mechanical properties of the article. The combined cold/hot isostatic pressing process is referred to as CHIP.

The CHIP process using elastomeric molds can produce extremely complex shapes, which are very difficult to achieve by forging processes. Caution must be used in applying parts made by this technique in critical components, such as rotating parts, where fatigue behavior is usually very important. Available data indicate that parts made from elemental material are inferior to wrought material in fatigue performance.

With the "pre-alloyed approach", spherical pre-alloyed powder is used. Spherical powder flows readily, with minimal bridging tendency, and packs to a very consistent density (approximately 65%). This leads to excellent part-to-part dimensional reproducibility. Pre-alloyed powder is generally HIP'd or otherwise hot pressed. Parts made from pre-alloyed powder generally exhibit better fatigue performance than those made of elemental powder, but are somewhat inferior to wrought material.

While mechanical working can be used on wrought articles to modify their structures and enhance properties, such treatment is not practical for net shape articles produced from powder. Eylon and Froes, two of the present inventors describe in U.S. patent application Ser. No. 617,445, and Ser. No. 617,447, both filed June 5, 1984, methods for refining the microstructure of articles made by powder metallurgy which generally comprise the steps of beta-solution heat treating the article for a relatively brief time, quenching the article, aging the article at a suitable temperature and air cooling the article to room temperature. These methods provide articles having a fine alpha plate microstructure in a matrix of a discontinuous beta phase, which exhibit increased fatigue strength.

We have found that the microstructure of net shape titanium alloy powder compacts can be further improved.

Accordingly it is an object of the present invention to provide a process for improving the microstructure of titanium articles made by powder metallurgy.

Other objects, aspects and advantages of the present invention will become apparent to those skilled in the art after reading the detailed description of the invention as well as the appended claims.

SUMMARY OF THE INVENTION

In accordance with the present invention there is provided a process for improving the microstructure of a titanium article made by powder metallurgy which comprises, in combination, the steps of:

(a) beta-solution heat treating the article for a relatively brief time;
(b) quenching the article;
(c) hydrogenating the article; and
(d) dehydrogenating the article.

DESCRIPTION OF THE INVENTION

Figure 1:
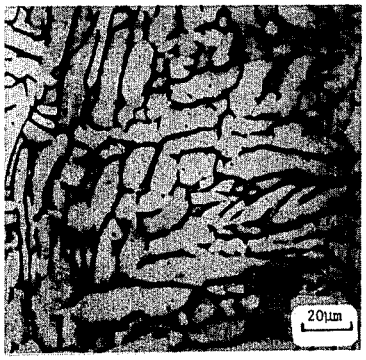
FIG. 1 is a 600× photomicrograph illustrating the microstructure of an article made by powder metallurgy of prealloyed Ti-6Al-4V.

The starting stock for production of net shape articles by powder metallurgy contains the desired alloy components. Suitable powders, whether prealloyed or compounded, include the alloys: Ti-6Al-4V, Ti-6Al-6V-2Sn, Ti-6Al-2Sn-4Zr-2-Mo, Ti-5Al-2.5Sn, Ti-2.5Al-13V-7Sn-2Zr, Ti-10V-2-Fe-3Al, Ti-11.5Mo-6Zr-4.5Sn, and the like.

Consolidation of the powder may be accomplished using any procedure known in the art. Following consolidation, the formed article may optionally be subjected to an annealing heat treatment. Such treatment is typically carried out at a temperature about 20 to 30% below the beta-transus temperature (in °C.) of the alloy for about 2 to 36 hours in a vacuum or inert environment to protect the surface of the article from oxidation. For example, heat treatment of Ti-6Al-4V alloy is typically carried out between 700°–800° C. for about 2 to 8 hours.

The method of the present invention comprises beta-solution treatment of an article produced by powder metallurgy, followed by rapid cooling to room temperature, followed by hydrogenation/dehydrogenation of the article. The beta-solution treatment is accomplished by heating the article, in an inert atmosphere of argon, helium, nitrogen, or the like, to approximately the beta-transus temperature of the alloy, i.e., from about 5% below to about 10% above the beta-transus temperature (in °C.), followed by rapid cooling. In a presently preferred embodiment, the beta-solution heat treatment is conducted by heating the article to a temperature in the approximate range of 0 to 5% above the beta-transus of the alloy, followed by rapid cooling. The period of time over which the article is held at or near the beta-transus temperature can vary from about 10 minutes to about 240 minutes, depending on the cross-section of the article, with thinner articles requiring a shorter holding time. The article can be quenched, i.e. cooled, in a flowing stream of cooled gas, such as air, or in water or oil.

Following the beta-solution treatment, the article is hydrogenated. Titanium and its alloys have an affinity for hydrogen, being able to dissolve up to about 3 w% (60 atomic %) hydrogen at 590° C. While it may be possible to hydrogenate the article to the maximum quantity, it is presently preferred to hydrogenate the article to a level of about 0.1 to 2.3 weight percent hydrogen.

Hydrogenation is conducted in a suitable, closed apparatus at an elevated temperature by admitting sufficient hydrogen to attain the desired concentration of hydrogen in the alloy. The hydrogenation step is conducted at a temperature of about 50% to 96% of the beta-transus temperature of the alloy. Heating of the article to the desired temperature is conducted under an inert atmosphere. When the hydrogenation temperature is reached, hydrogen is added to the atmosphere within the apparatus. The partial pressure of hydrogen added to the atmosphere and the time required for hydrogenation are dependent upon such factors as the size and cross-section of the article, the temperature of hydrogenation and the desired concentration of hydrogen in the article.

After hydrogenation, the admission of pure hydrogen into the apparatus is discontinued and the apparatus is preferably flushed with a non-flammable mixture of an inert gas and about 4% hydrogen. The article is allowed to equilibrate at the hydrogenation temperature for about 10 to 120 minutes, and then furnace cooled.

Dehydrogenation of the hydrogenated article is accomplished by heating the article, under high vacuum, to a temperature in the range given above, i.e., about 50% to 96% of the beta-transus temperature of the alloy. The time for hydrogen removal will depend on the size and cross-section of the article and the volume of hydrogen to be removed. The time for dehydrogenation must be sufficient to reduce the hydrogen content in the article to less than the maximum allowable level. For the alloy Ti-6Al-4V, the final hydrogenation level must be below 120 ppm (0.012 w%) to avoid degradation of the physical properties such as room temperature ductility.

The dehydrogenation step is conducted by heating the article in a vacuum furnace under vacuum to dehydrogenation temperature. The article may be held at dehydrogenation temperature, under vacuum, for about 15 to 60 minutes per one-half inch of cross-section, to ensure substantially complete evolution of hydrogen from the article. Heating is then discontinued and the article is allowed to furnace cool. The phrase "furnace cooling" means that heating is discontinued and the apparatus is allowed to cool to the external ambient temperature. Those skilled in the art will recognize that the rate of such cool down is dependent upon facturs such as the construction of the apparatus, atmospheric currents in the surrounding vicinity, etc.; that a well-insulated furnace will cool down at a slower rate than one not well-insulated. The rate of furnace cooling can vary between about 10° and 200° C. per hour. It is presently preferred that the cooling rate be about 50° C. per hour.

The term "vacuum" is intended to mean a vacuum of about $10^{-2}$ mm Hg or less, preferably about $10^{-4}$ mm Hg or less.

The benefits of the method of this invention are illustrated in FIGS. 1–4. A typical microstructure of a consolidated article prepared by powder metallurgy of prealloyed Ti-6Al-4V powder is shown in FIG. 1. The structure is a mixture of low and high aspect ratio coarse alpha plates separated by a continuous beta phase.

Figure 2:
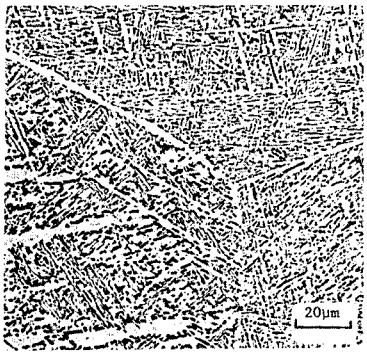
FIG. 2 is a 600× photomicrograph illustrating the microstructure of an article made by powder metallurgy of a prealloyed Ti-6Al-4V and treated in accordance with the present invention.

FIG. 2 illustrates a structure resulting from beta solution treatment/hydrogenation/dehydrogenation in accordance with the present invention. The grain boundary alpha is no longer continuous and the transgranular microstructure is much finer than the as-consolidated structure.

Figure 3:
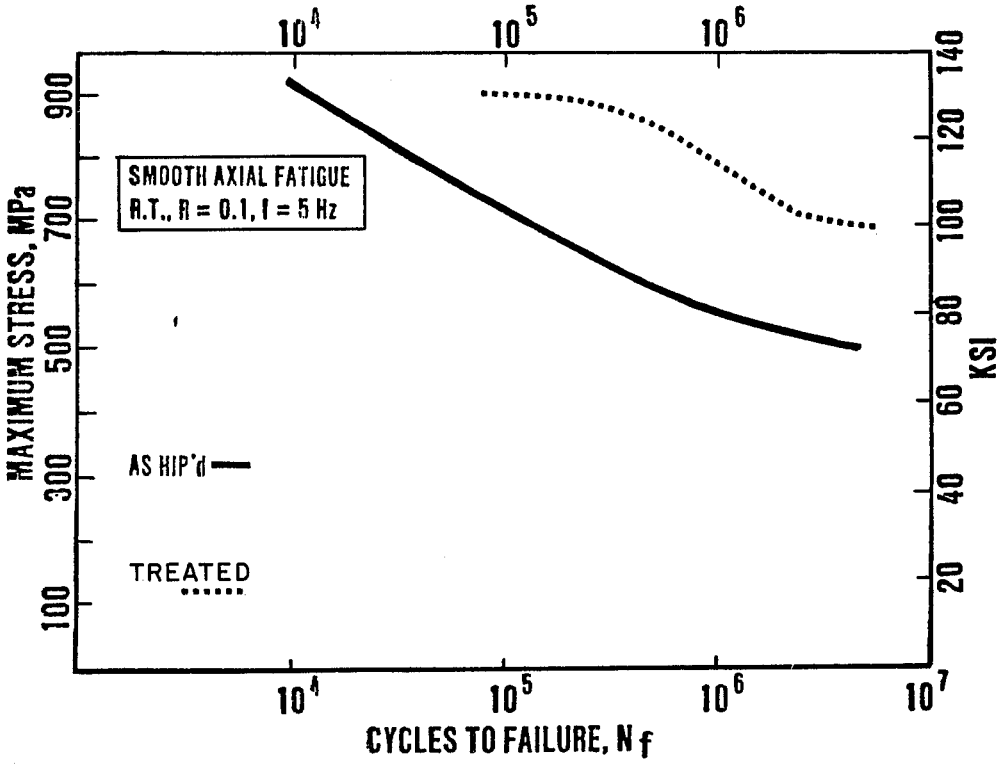
FIG. 3 is a graph illustrating the smooth axial fatigue strength of untreated and treated Ti-6Al-4V powder compacts.

FIG. 3 illustrates the smooth axial fatigue strength of a series of compacts prepared by consolidating prealloyed Ti-6Al-4V powder. The solid line represents the fatigue data of compacts HIP'd at 925° C. (1700° F.) at 105 MPa (15 Ksi) for 5 hours. The broken line represents the increased fatigue strength of compacts which were treated in accordance with the invention as follows: 1025° C. (1880° F.) for 20 minutes followed by water quench to room temperature followed by hydrogenation at 593° C., followed by dehydrogenation at 760° C.

Figure 4:
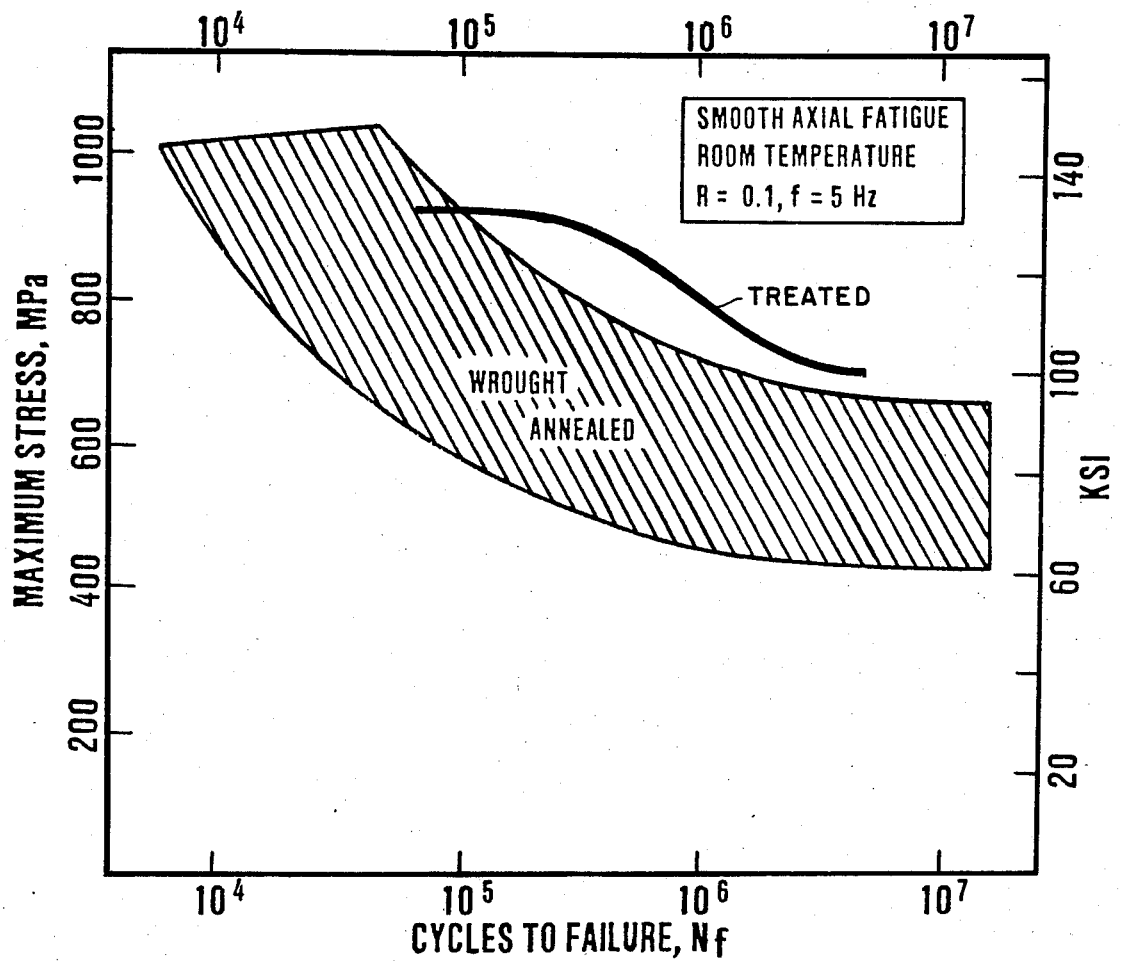
FIG. 4 is a graph illustrating the smooth axial fatigue strength of treated Ti-6Al-4V powder compacts versus cast and wrought annealed material.

FIG. 4 illustrates the smooth axial fatigue strength of the series of powder compacts described in the preceding paragraph (solid line) compared to the scatterband of cast and wrought annealed material (crosshatched area).

The method of this invention is generally applicable to the manufacture of aircraft components, as well as non-aerospace components. This method is particularly applicable to the production of fatigue-resistant titanium alloy articles, such as, for example, aircraft engine mount supports, load carrying wing sections and nacelles, turbine engine compressor blades and the like, as well as articles for surgical body implantation, such as hip joints.

EXAMPLE

A series of compacts were prepared by consolidating prealloyed Ti-6Al-4V powder. These compacts were hot isostatically pressed (HIP'd) at 925° C., 105 MPa for 5 hours. A portion of the compacts were beta solution heat treated at 1025° C. for 20 minutes followed by water quenching, then hydrogenated to 1.4 w% hydrogen at 590° C., then dehydrogenated at 760° C. The tensile properties of HIP'd compacts are compared to compacts treated in accordance with the invention in the following table:

TABLE

| Material Condition | 0.2% YS, MPa (Ksi) | UTS MPa (Ksi) | EL, % | RA, % |
|---|---|---|---|---|
| Untreated | 841 (122) | 910 (132) | 18 | 40 |
| Treated | 965 (140) | 1048 (152) | 8 | 17 |

Various modifications may be made to the present invention without departing from the spirit and scope of the invention.

We claim:

1. A method for improving the microstructure of a powder compacted article made by powder metallurgy of titanium alloy powder which comprises, in combination, the steps of:

a. beta-solution heat treating said article at a temperature approximately equal to the beta-transus temperature of said alloy;

b. cooling said article at a rate in excess of air cooling to room temperature;

c. hydrogenating said article at a temperature in the approximate range of 50 to 96% of said beta-transus temperature; and d. dehydrogenating said article at a temperature in the approximate range of 50 to 96% of said beta-transus temperature.

2. The method of claim 1 wherein said beta-solution heat treatment is carried out at a temperature ranging from about 5% below to about 10% above said beta-transus temperature for about 10 to 240 minutes.

3. The method of claim 1 wherein said beta-solution heat treatment is carried out at a temperature in the approximate range of 0 to 5% above said beta-transus temperature for about 10 to 240 minutes.

4. The method of claim 1 wherein said dehydrogenation step comprises cooling said article at a rate in the approximate range of 10° to 200° C. per hour.

5. The method of claim 4 wherein said cooling rate is about 50° C. per hour.

6. The method of claim 1 wherein said article is hydrogenated to a hydrogen level of about 0.1 to 2.3 weight percent.

7. The method of claim 1 wherein said alloy is Ti-6Al-4V and said article is dehydrogenated to a hydrogen level below 0.012 weight percent.

* * * * *